US011845637B2

(12) United States Patent
Kasbergen et al.

(10) Patent No.: US 11,845,637 B2
(45) Date of Patent: Dec. 19, 2023

(54) STAIRLIFT FOR A RIGHT HAND USER AND A LEFT HAND USER

(71) Applicant: TK HOME SOLUTIONS B.V., LN Krimpen aan den Ijssel (NL)

(72) Inventors: Paul Kasbergen, CM Capelle aan den Ijssel (NL); Cornelis Boxum, GV Delfgauw (NL); Wim Heijns, AL Kinderdijk (NL)

(73) Assignee: TK HOME SOLUTIONS B.V., Krimpen aan den Ijssel (NL)

( * ) Notice: Subject to any disclaimer, the term of this patent is extended or adjusted under 35 U.S.C. 154(b) by 0 days.

(21) Appl. No.: 17/928,160

(22) PCT Filed: May 25, 2021

(86) PCT No.: PCT/EP2021/063877
§ 371 (c)(1),
(2) Date: Nov. 28, 2022

(87) PCT Pub. No.: WO2021/239719
PCT Pub. Date: Dec. 2, 2021

(65) Prior Publication Data

US 2023/0219788 A1 Jul. 13, 2023

(30) Foreign Application Priority Data

May 29, 2020 (EP) ..... 20177318

(51) Int. Cl.
*B66B 9/08* (2006.01)
*B66B 1/34* (2006.01)

(52) U.S. Cl.
CPC ..... *B66B 9/0853* (2013.01); *B66B 1/3446* (2013.01)

(58) Field of Classification Search
CPC ..... B66B 9/0853; B66B 1/3446
See application file for complete search history.

(56) References Cited

U.S. PATENT DOCUMENTS

2016/0075535 A1 3/2016 Ooms

FOREIGN PATENT DOCUMENTS

WO 2013/160675 A2 10/2013

OTHER PUBLICATIONS

Thyssenkrupp Accessibility: "Flow2 stairlift—User Manual", Dec. 2007 (Dec. 6, 2007), XP055754321, Retrieved from the Internet: URL:https://liftabilityltd.com/wp-content/ uploads/2017/07/User-Manual-V2007.12.06 we b. pdf [retrieved on Nov. 26, 2020] pp. 9-28.

Thyssenkrupp Accessibility: "Flow2 stairlift—Tab07: Disassembly and assembly", Mar. 7, 2007 (Mar. 7, 2007), XP055754322, Retrieved from the Internet: URL:http://www.schodolez.info/THYSSEN VIDE 0 AND PICTURES/FLOW/Flow2-Demounting-Demon taz.pdf [retrieved on Nov. 26, 2020] sections 2.2, 2.3.

(Continued)

*Primary Examiner* — Jeffrey Donels
(74) *Attorney, Agent, or Firm* — Dinsmore & Shohl LLP

(57) ABSTRACT

The present invention refers to a stairlift (1) comprising a first armrest (10) and a second armrest (10), wherein each armrest (10) is adapted to comprise at least one module (11, 12), and wherein said at least one module (11, 12) is adapted to provide at least one user control function; characterized in that the at least one module (11, 12) is adapted to be interchangeable between the first and second armrests (10).

18 Claims, 3 Drawing Sheets

(56) References Cited

OTHER PUBLICATIONS

Thyssenkrupp Accessibility: "Flow2 stairlift—Tab 04: Install, adjust and release", Mar. 7, 2007 (Mar. 7, 2007), XP055754327, Retrieved from the Internet: URL:http://www.schodolez.info/THYSSEN VIDE 0 AND PICTURES/FLOW/Flow2-Installing-Tnsta lace.pdf [retrieved on Nov. 26, 2020] sections 3.4, 3.6.3.

STAIRLIFT FOR A RIGHT HAND USER AND A LEFT HAND USER

CROSS-REFERENCE TO RELATED APPLICATIONS

This application is the U.S. national stage of PCT/EP2021/063877 filed May 25, 2021 which claims priority of EP Application No. EP20177318.1 filed May 29, 2020.

TECHNICAL FIELD OF INVENTION

The invention relates to a stairlift comprising a first armrest and a second armrest, wherein each armrest is adapted to comprise at least one module, which can be adapted to a right hand user and a left hand user.

BACKGROUND

A stairlift, is a product which is typically meant for people with impaired mobility to provide support in travelling up and down a staircase whilst maintaining the functionality of the stairs for persons who are able to climb the stairs themselves. The stairlift is often installed in a person's home and typically comprises a drive unit that is arranged to drive a user carrier, e.g., a chair or a wheelchair platform, along a rail, mounted on or along one or more flights of a staircase.

A known stairlift system in the art is equipped with armrests which can be folded when storing the lift on the staircase. This is usually performed by rotating the armrests around a substantially horizontal axis. The armrests can be curved or straight for larger users. The chair of the stairlift must be equipped with a seatbelt to prevent the user from sliding off the chair according to a stairlift safety standard.

At least one armrest can be equipped with a joystick to operate the movement of the stairlift. In some stairlifts, when the joystick is removed, the stairlift will perform an emergency stop. In some stairlifts, when the joystick is not present to begin with, the stairlift cannot be operated such that the joystick functions as a key-lock to prevent unintended use by unauthorised persons.

Normally, to operate the joystick while sitting on the chair, the user needs to have the corresponding armrest in the unfolded state. The stairlift safety standard requires an armrest deployed (unfolded) detection unit at the armrest which is positioned at the valley side of the chair. In some stairlifts, a detection unit is not present in the chair, instead the joystick is always mounted at the valley side armrest, to force the user to have the valley side armrest in its deployed position (unfolded) to be able to use the joystick to operate the stairlift when seated in the chair. It is known for the opposite armrest to be optionally equipped with a call device.

In some stairlifts, the seatbelt can have its winding mechanism installed at the left or the right side of the chair, and the buckle is then installed at the opposite side of the chair. Normally, the winding mechanism is installed in the armrest which does not contain the joystick, due to a space-claim overlap between the winding mechanism and the cable to the joystick.

WO 2018/162627 A1 discloses a stairlift comprising an armrest wherein the armrest is pivotally supported at the chair by a hinge, which allows a rotational movement of the armrest along a vertical axis. It also discloses a method of detecting an angular position of the armrest wherein at least one functionality of the stairlift is controlled as a function of the detected angular positon.

GB 2469093 A discloses a stairlift chair having a pair or spaced armrests, each armrest having a fixed element adjacent a side edge and a moving element displaceable about a vertical axis. Operating controls for the lift are located on a moving portion of the arms and the arms may be locked in extended, folded or intermediate positions.

WO 2004/083094 A1 provides a containment device including a reel mounted for rotation in a reel carrier having a length of web wound onto and fixed at one end to said reel. The containment device further included locking means operable to lock the position of said web or belt with respect to a reel housing wherein the act of engaging the fixing component of said reel carrier to the fixing component of said installation causes said locking means to operate.

JP2004016739 discloses a chair armrest structure of a chair type stair lift that is operated in a push-down direction to prevent protrusions on the seat surface so that it is more convenient for wheelchair users and enables smooth transfer.

JP05241004B2 discloses an operating panel for a chair-type stairlift installed in a stairway.

SUMMARY OF INVENTION

The art fails to address the problems that can arise when a stairlift user is unable to use their left or right hand anymore. When the valley side of the chair does not correspond to the preferred hand of the user, the joystick might not be easy to operate. This applies also to the seatbelt. The location of the winding mechanism at either the left or at the right side, depends on the location of the joystick and thus indirectly on the staircase and the stairs on which it is to be installed. These features are fixed and cannot be chosen by the user, yet a user may still have preferences as to which side their seatbelt is located on or on which side the joystick is positioned due to physical restrictions.

Stairlifts have several user controls which are positioned at different locations. The joystick and call device are usually placed in the armrest, the emergency lowering user control is usually placed in the drive and the seatbelt elements are usually placed underneath the armrests.

The emergency lowering user control can be especially hard to find and hard to operate for a user, as can the seatbelt, particularly when the armrests are folded.

It is thus an object of the invention, to provide a stairlift wherein it can be configured according to a user's preference having consideration for any physical disabilities the user may have, in particular in the user's arms or hands.

This object is solved by a stairlift according to claim 1 and a method according to claim 12, wherein further preferred embodiments are given by the dependent claims and the following description.

The invention refers to a stairlift comprising: a first armrest in particular a rotatable armrest; a second armrest, in particular a rotatable armrest; a seat body; preferably a backrest body; a drive unit; wherein each armrest is adapted to comprise at least one module, and wherein said at least one module comprises at least one user control for influencing the movement of the seat body by a hand of a user; characterized in that the at least one module is adapted to be interchangeable between the first and second armrests.

The user control, which is configured for influencing the movement of the seat body by a hand of a user, can be designed as joystick, by means of which the user may initiate a movement of the seat body in one direction, a movement of the seat in the opposite direction and/or stop the movement of the seat body. Further the user control for influencing the movement of the seat body by a hand of a user could be a touch pad and/or keypad and/or other means for manipulating the movement of the seat body, by means of which the user may initiate a movement of the seat body in one direction, a movement of the seat in the opposite direction and/or stop the movement of the seat body. The user control, which provides the user control function of influencing the movement of the seat body by a hand of a user, is preferably connected to the drive unit, so that the drive unit can be stopped and/or operated in the one or opposite drive direction in reaction to an input of the user's hand into the user control. The user control can provide different user control signals, which can be selected by the hand of the user manipulating the user control. The user control signal can be transmitted to a corresponding receiver, for instance the drive unit, for fulfilling its associated user control function.

Since the user control for influencing the movement of the seat body is provided by the interchangeable module, the user control for influencing the movement of the seat body can be exchanged together with the exchange of the module between the armrest at the right side and the armrest at the left side even after the first installation of the stairlift. For instance, the stairlift can be adapted to a right hand user at the first installation, but easily adapted to a left hand user later on by only exchanging the first module and the second module between the first armrest and the second armrest. Particularly when the strong hand of the user became temporarily or permanently impaired after the first installation of the stairlift, a convenient use of the stairlift by the use can be easily provided by exchanging the modules and without the need of exchanging the armrest or further parts of the stairlift. This advantageously provides a stairlift wherein the user controls are grouped together in the armrest, in such a way that they are easily exchangeable between the left and the right side of the stairlift.

Particularly only the first module comprises the at least one user control for influencing the movement of the seat body by a hand of a user, wherein the second module comprises no user control at all or a different kind of user controls. The second module may be blind, e.g. haven no function beside filling a space filled by the first module else. Preferably the second module comprises user controls which are not adapted to influencing the movement of the seat body but for a different purpose, which can be handled by the user using his weak hand. The at least one user control of second module may comprise a telecommunication unit and/or are adapted for providing further user control function, for which the actuation of the drive unit is not required.

The first module and/or the second module may comprise a battery for providing electrical energy, which may be needed for generating signals when the user control is manipulated by the user. Particularly the battery is rechargeable and/or exchangeable. In addition or in the alternate, the first module and/or the second module may by fed by electrical energy via an electrical source outside the first module and/or the second module, particularly by an electrical source for feeding the drive unit. The first module and/or the second module can be designed as battery-free unit. The first armrest van be the armrest located at the right side of the seat body, wherein the second armrest is the armrest located at the left side of the seat body, or vice versa. Particularly the first armrest is adapted to be used on the right side and also at the left side of the seat body, wherein the second armrest is adapted to be used on the left side and also at the right side of the seat body.

In an embodiment of the invention, at least a first module is comprised preferably in a front section of the first armrest or the second armrest and at least a second module is comprised preferably in a front section of the second armrest or the first armrest. This advantageously ensures that the stairlift can be configured according to a user's preference, e.g., the joystick no longer has to be located at the valley side, this can be beneficial for a user who has one hand stronger than the other. Thus, the ergonomics of the stairlift can be significantly improved.

Preferably the first armrest comprises a first compartment for receiving the first module or the second module and the second armrest comprises a second compartment for receiving the second module or the first module, wherein the first compartment and the second compartment each comprises all electrical connectors for transmitting signals provided by the first module and the second module. Each compartment may comprise all electrical connectors for transmitting signals provided by the first module and the second module, if the second module is adapted to generate signals. However, it is possible, that only a part of the electrical connectors is used by the first module only and, if so, another part of the electrical connectors are used by the second module only. The respective compartment may comprise holding means, for instance releasable clip connectors, for attaching the respective module into the associated compartment of the respective armrest.

In an embodiment of the invention, the first module is adapted to provide one or more first user control function. An example of a first user control function includes but is not limited to: e.g.: a control device, e.g., a joystick; an emergency stop button; wireless connectivity capabilities, e.g., via radio frequency (RF) electronics including a remote control, a transceiver, an emitter. This advantageously provides an armrest having at a specific section which is within easy reach of a user, a module that can perform multiple basic functions of the stairlift. This ultimately improves passenger comfort as well as safety.

In an embodiment of the invention, the second module is adapted to provide one or more second user control function wherein the second user control function is preferably different from the first user control function. An example of a second user control function includes but is not limited to: a footrest folding button; a seat folding button; a call feature, wherein said call feature can comprise a wireless module, e.g., a DECT module with a speaker, a microphone and a button to operate the call feature. This advantageously provides an armrest having at a specific section which is within easy reach of a user, a module that can perform multiple advanced functions of the stairlift; which will ultimately improve passenger comfort as well as safety.

In an embodiment of the invention, the first module and/or second module is adapted to send and receive radio frequency (RF) signals from a remote control device. This advantageously provides a stairlift which can be remotely controlled. The remote control device may the same device used to control the movement of the stairlift along its rail to travel from one landing area to another landing area.

In an embodiment of the invention, each armrest comprises a seatbelt section comprising a seatbelt module wherein the seatbelt module comprises: a winding mechanism, including a seatbelt webbing and a seatbelt buckle; a seatbelt eye. In an embodiment of the invention, the seat belt module, preferably the winding mechanism, i.e., the seatbelt webbing and seatbelt buckle of the seatbelt module, is located on the first armrest and the seatbelt eye is located on the second armrest (10) or vice versa. This advantageously provides a stairlift which can be adapted to suit a passengers hand dexterity.

In an embodiment of the invention, each armrest optionally comprises at least one further user control function including: a key-lock; an emergency lowering button.

These user control functions can be comprised in the first or second modules. In an embodiment of the invention, the emergency lowering button is preferably located in the first module. It can however, also be comprised in the second module. In an embodiment of the invention, the key-lock is preferably located in the first module or in the second module.

In an embodiment of the invention, the front section of each armrest is adapted such that the modules have an identical fit. This advantageously facilitates the interchange of the modules between the armrests. The front section of each armrest may comprise a compartment for receiving the respective module.

In an embodiment of the invention, the seatbelt section of each armrest is adapted such that the winding mechanism and the seatbelt eye have an identical fit. This advantageously facilitates the interchange of the seatbelt module between the armrests.

In an embodiment of the invention, the armrests are adapted to rotate about a horizontal or vertical axis. The armrests can preferably be locked in various positions, A, B, C, D this is shown more clearly in the figures.

The invention also relates to a method of configuring a stairlift, which is particularly designed as previously described, comprising: a first armrest in particular a rotatable armrest; a second armrest in particular a rotatable armrest; a seat body; preferably a backrest body; a drive unit; comprising the method steps of; installing a first module (11) at the first armrest (10) and a second module (12) at the second armrest (10), wherein the first module (11, 12) comprises at least one user control for influencing the movement of the seat body by a hand of a user; wherein after installation, the first module and/or second module and/or optionally the seatbelt module are interchangeable between the first armrest and second armrest; and wherein when interchanging the first module and the second module and/or optionally the seatbelt module, the stairlift is powered. This advantageously provides a stairlift that can be easily and safely configured and re-configured according to a passenger's needs. The method can be further designed as previously described with reference to the stairlift.

In an embodiment of the invention, the stairlift automatically reconfigures once any change of first and/or second module occurs at the armrests.

In an embodiment of the invention, the method further comprises the steps of: uninstalling the first module from its armrest; uninstalling the second module from its armrest; optionally uninstalling the seatbelt module from its armrest(s), wherein the seatbelt module comprises a winding mechanism and a seatbelt eye. The first armrest preferably comprises the winding mechanism and the second armrest preferably comprises the seatbelt eye or vice versa; re-installing the first module at the armrest which previously hosted the second module; re-installing the second module at the armrest which previously hosted the first module.

In an embodiment of the invention, the method further comprises the step of: optionally installing at the first or second armrest a key-lock or an emergency lowering button. This advantageously improves the safety features of the stairlift.

In an embodiment of the invention, the method further comprises the step of optionally activating at least the first module and/or second module, and/or optionally the seatbelt module, manually or via a remote control device. The remote control device may the same device used to control the movement of the stairlift along its rail to travel from one landing area to another landing area. This advantageously provides a stairlift wherein multiple user control functions can be controlled from a remote control device, thereby facilitating a user who has reduced hand dexterity and who has to rely on a helper's assistance.

BRIEF DESCRIPTION OF THE DRAWINGS

The invention is described in more detail with the help of the figures.

DETAILED DESCRIPTION

Figure 1:
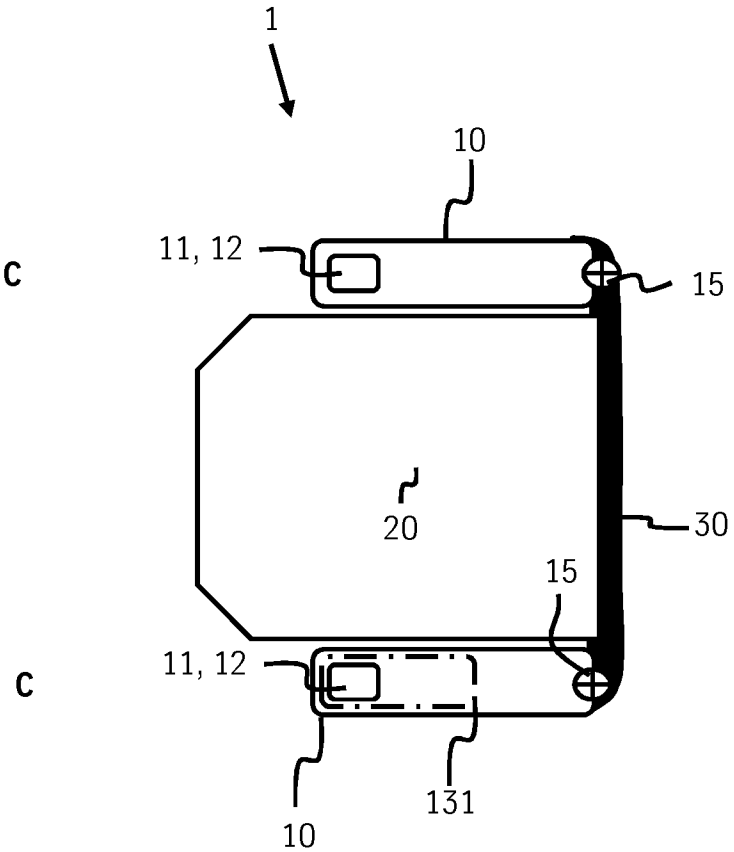
FIG. 1 shows a schematic representation of a top view of a stairlift according to an embodiment of the invention.

FIG. 1 shows a top view of a stairlift 1 according to an embodiment of the invention. The stairlift 1 comprises an armrest 10 on each side of a seat body 20. The armrests 10 and seat body 20 are shown in this particular example as being supported at a backrest body 30, however this is for illustration purposes only and not to be interpreted as a limiting feature of the invention. A front section 131 of the armrest 10 comprises at least one module 11, 12, wherein said module 11, 12, is adapted to provide at least one user control function. In this embodiment, a first module 11 provides the functions of: a joystick, an emergency stop button and RF electronics.

Figure 2:
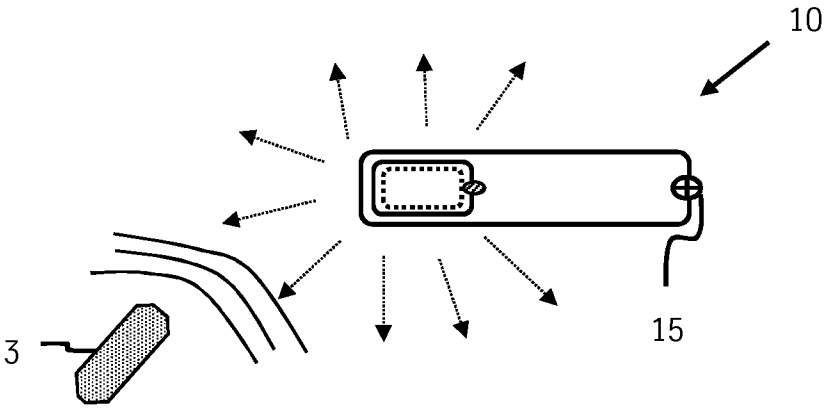
FIG. 2 shows a schematic representation of an armrest according to an embodiment of the invention.

Hereinafter, the first module 11 shall be referred to as a joystick module 11. The joystick module 11 in this particular example contains opto-couplers (not shown) whose light signals are blocked or not by means of a vane, which is coupled to the joystick movement. The joystick function in the joystick module 11 comprises an RF electronic system which is used to transfer signals to and from a remote control 3, this is shown in FIG. 2. In this particular example, the joystick module 11 also comprises an electronic system that is connected to a control board 21 of the stairlift (shown in FIG. 6).

A second module 12 comprises the functions of: optional user controls. Hereinafter the second module 12 shall be referred to as an options module 12. Depending on the desired features of the stairlift 1, the options module 12 will have different optional functions. In this particular example, the options module 12 comprises; a footrest folding button, a seat folding button and a call feature, wherein this comprises one or more of: a DECT module, a speaker, a microphone and/or a button to operate the call feature.

Figure 3:
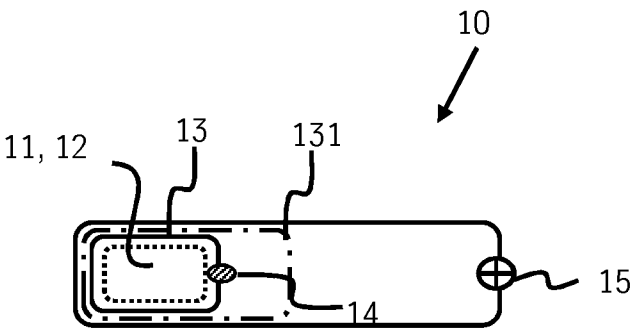
FIG. 3 shows a schematic representation of an armrest according to an embodiment of the invention.

The joystick and option modules 11, 12 can easily be exchanged from one armrest 10 to the other by removing at the front section 131 of the armrest 10, a cover 13 and an attachment means 14 as shown in FIG. 3. In this example, the attachment means is a screw 14. The exchange of modules 11, 12, will be further explained at a later stage.

The electrical connectivity of the joystick and option modules 11, 12 is established by means of spring-loaded contacts (not shown) which engage a printed circuit board, i.e., a connection board (not shown). The connection board is connected to an armrest board 17 via a cable 18. All electronics in the armrest are connected to this armrest board 17 via the cable 18. This is shown in more detail in FIG. 6.

Figure 5:
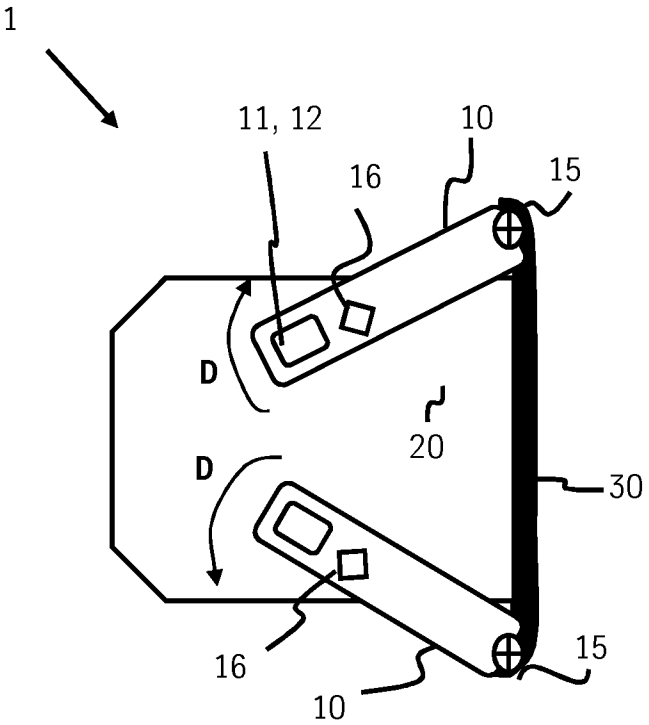
FIG. 5 shows a schematic representation of a top view of a stairlift according to an embodiment of the invention wherein the armrests are in different rotated positions.
Figure 4:
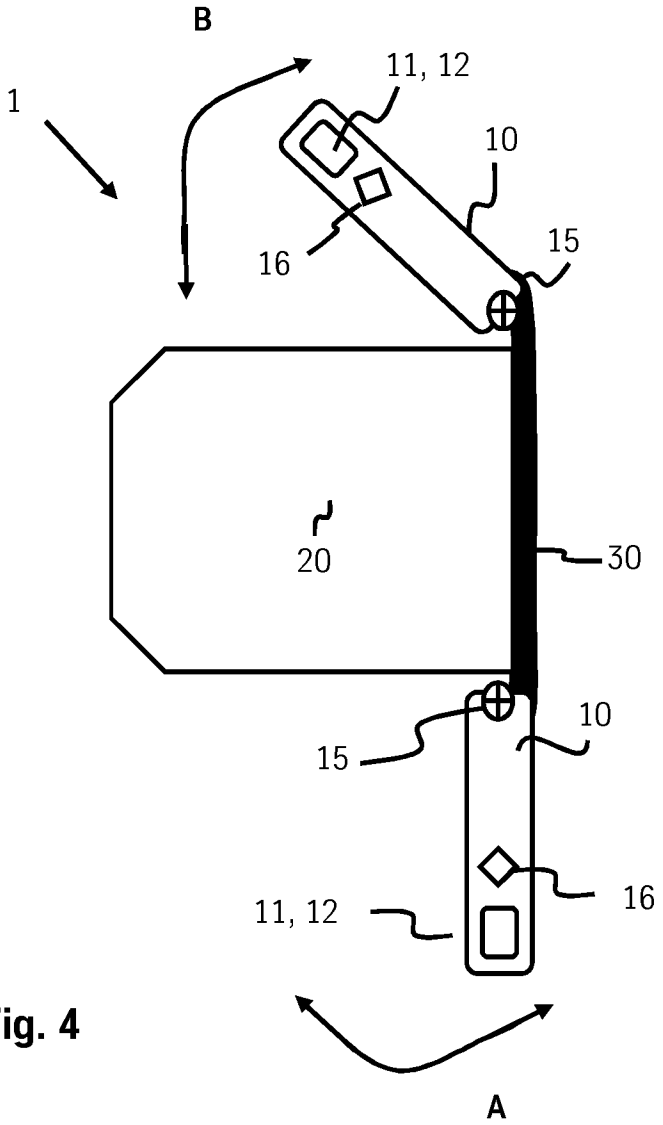
FIG. 4 shows a schematic representation of a top view of a stairlift according to an embodiment of the invention wherein the armrests are in different rotated positions.

The back section of the armrest contains a hinge construction 15, which enables the armrest to rotate around a substantially vertical axis, which is embodied by a hollow shaft (not shown). FIG. 1 shows the armrests 10 both locked in position C. The armrests 10 can rotate and can be locked in multiple positions A, B, C, D. In FIG. 4, the armrests 10 are in positions A and B, whilst in FIG. 5, the armrests 10 are both in position D. The locking and unlocking of the rotational movement is performed by means of a latch (not shown) which moves in and out slots of the hollow shaft. The latch can be operated manually by means of a slider mechanism 16, shown in FIGS. 4 and 5, which are located behind the joystick or options module 11, 12. The slider mechanisms 16 are present in both armrests 10, therefore exchange between armrests 10 is not necessary.

The armrests 10 also comprise a position and lock detection device (not shown) to detect the rotational positions A, B, C, D of both armrests 10. As a result, the location of the joystick module 11 is not bound to the valley side of the stairlift 1 anymore and can be freely chosen by the end user. Also, due to the interchangeability of the modules 11, 12, the end user is free to choose the position of a seatbelt winding mechanism (not shown), which due to the inventive configuration of the armrests 10 is now also independent of the position of e.g. the joystick module 11.

Figure 6:
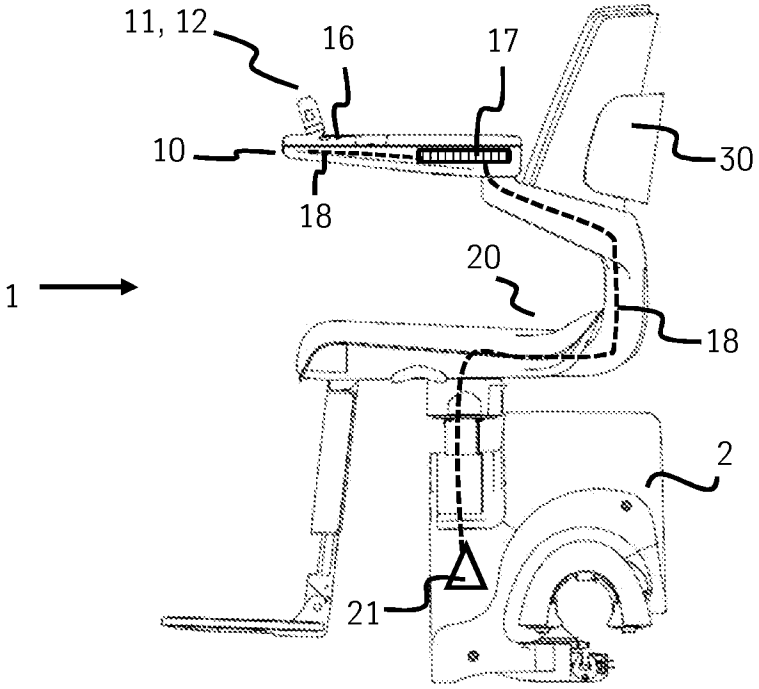
FIG. 6 shows a schematic representation of a stairlift according to an embodiment of the invention.

Referring back to the electrical conductivity of the modules 11, 12 and other components comprised in the armrests 10, FIG. 6 shows the armrest board 17 located at the top of the back section of the armrest 10. Whilst only one armrest 10 is shown, this applies equally to the second armrest 10. All electronics in the armrest 10 are connected to the armrest board 17 via the armrest cable 18. The armrest board 17 is connected to a control board 21 in the drive unit 2 by means of cabling 18 through the chair 1 and the drive 2. Whilst not shown in FIG. 6, the cabling section 18 contains a curled section positioned in said hollow shaft of each armrest 10. When the armrest 10 rotates, the bends of the curled cable 18 become smaller or larger, depending on the direction of rotation. The curls of the cable 18 do not touch each other, to prevent wear due to rubbing during the rotations. In this way the cable 18 is enabled to follow the movement of the armrest 10 without getting damaged. The left armrest cable 18 is exactly the same as the right armrest cable 18; since it can rotate to both directions, there is no need to have two mirrored variants. The power and data transfer between the control board 21 in the drive 2 and both armrest boards 17 through said cabling 18 is accomplished by means of a CAN bus system, in this particular example, a CAN 2.0 system.

Figure 7:
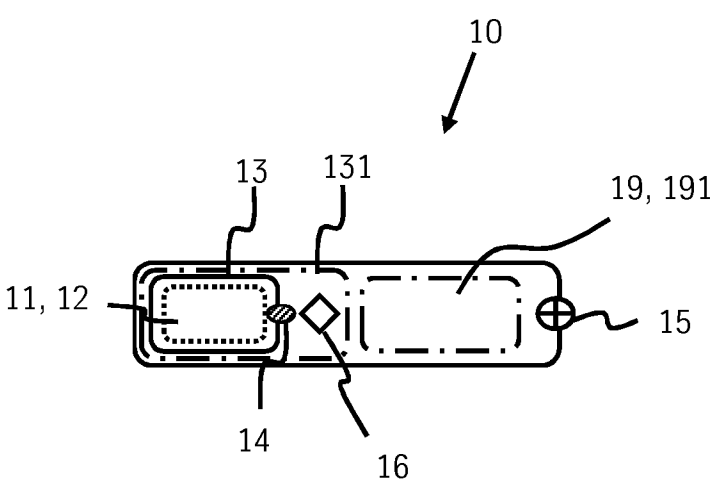
FIG. 7 shows a schematic representation of an armrest according to an embodiment of the invention.

FIG. 7 shows a further module 19, which comprises seatbelt components, i.e., a seatbelt module 19. This module 19 is located at the section behind the slider mechanism 16. An optional key-lock and an emergency lowering button can also be located here. The emergency lowering button, is an electrical switch, and is always located at the same side as the joystick module 11. The key-lock is also an electrical switch, but it can optionally be installed in the armrest 10 that does not contain the joystick module 11.

The seatbelt module 19 is comprised in the in the seatbelt section 191 of the armrest 10 and comprises a winding mechanism (not shown), including the seatbelt webbing and the seatbelt buckle mounted to one armrest 10 and a seatbelt eye at the other armrest 10. The seatbelt eye contains an opto-coupler which detects the presence of the seatbelt buckle by means of a moving slider.

The interchangeability of the armrests 10 is accomplished as follows. The joystick 11 module and the option 12 module have an identical fit in the front section 131 of the armrest 10 and the seatbelt module 19 has an identical fit in the seatbelt section 191 of the armrest 10. The exchange of modules 11, 12 between pairs of armrests 10 can be easily carried out by mounting and dismounting one or more screws at the interface between the one or more modules 11, 12, and the respective armrest 10. The exchange of the seatbelt module 19 between pairs of armrests 10 can be easily carried out by mounting and dismounting one or more screws at the interface between the seatbelt section 191 and the respective armrest 10. Both armrests 10 contain an identical cable 18 between the armrest board 17 and the connection board (not shown), to which the joystick module 11 and/or the options module 12 is connected.

In the armrest 10 that contains the joystick module 11, the emergency lowering button is connected to the armrest cable 18, in the other armrest 10, optionally a key-lock is connected. In either one of the armrests 10, a seatbelt eye is connected.

The detection of the modules 11, 12 in the armrests 10 is accomplished as follows. Both armrests 10 have an armrest board 17 each having its own ID on the CAN bus. Once the stairlift is installed and put into operation mode, an armrest board 17 checks if a joystick module 11 is connected by verifying whether a RS-232 connection is established or not. If so, the joystick module 11 is present, if not an options module 12 is expected to be present. When a joystick module 11 is connected to a certain armrest board 17, an input is transferred to the CAN bus as an emergency lowering command; otherwise, this input is transferred as a key-lock command.

The opto-coupler PCB in the seatbelt eye is built in such a way that it provides a pattern signal e.g., a sine signal, a PWM signal when blocked by the seatbelt, i.e., the seatbelt is connected. When the opto-coupler is not blocked, i.e., the seatbelt is not connected, it provides a continuous signal. If the signal is neither continuous nor patterned, the seatbelt eye is not present and therefore it is understood by the CAN bus to be present on the other armrest board 17. Finally, the control board checks if the configuration is complete and valid, by reading out the heartbeat signals of both armrest boards 17 on the CAN bus.

It is to be understood that aspects of the various embodiments described hereinabove may be combined with aspects of other embodiments while still falling within the scope of the present disclosure. Accordingly, the foregoing description is intended to be illustrative rather than restrictive. The assembly of the present disclosure described hereinabove is defined by the claims, and all changes that fall within the meaning and range of equivalency of the claims are to be embraced within their scope.

REFERENCE SIGNS LIST

1 stairlift
2 stairlift drive unit

3 remote control
10 armrest
11 module
12 module
13 cover
131 front section
14 attachment means
15 hinge
16 locking mechanism
17 armrest board
18 armrest cable
19 seatbelt module
191 seatbelt section
20 seat body
21 control board
30 backrest body
A-D armrest position

The invention claimed is:

1. A stairlift comprising:
a seat body;
a first armrest positioned on one side of the seat body;
a second armrest positioned on another side of the seat body;
a drive unit operatively coupled to the seat body;
wherein each armrest is adapted to comprise at least one module;
wherein said at least one module comprises at least one user control for influencing the movement of the seat body by a hand of a user; wherein the at least one module is adapted to be interchangeable between the first and second armrests; and
wherein the first module is adapted to provide one or more first user control function, the second module is adapted to provide one or more second user control function wherein the second user control function is different from the first user control function.

2. The stairlift according to claim 1, wherein the first armrest comprises a first compartment for receiving the first module or the second module and the second armrest comprises a second compartment for receiving the second module or the first module, wherein the first compartment and the second compartment each comprises all electrical connectors for transmitting signals provided by the first module and the second module.

3. The stairlift according to claim 1, wherein the first module is adapted to send and receive radio frequency (RF) signals from a remote control device.

4. The stairlift according to claim 1, wherein each armrest comprises a seatbelt section comprising a seatbelt module wherein the seatbelt module comprises:
a winding mechanism;
a seatbelt eye,
wherein the winding mechanism, is located on the first armrest and the seatbelt eye is located on the second armrest or vice versa.

5. The stairlift according to claim 1, wherein each armrest optionally comprises at least one user control function including: a key-lock; an emergency lowering button.

6. The stairlift according to claim 5, wherein the emergency lowering button is located in the first module or in the second module.

7. The stairlift according to claim 6, wherein the key-lock is located in the first module or in the second module.

8. The stairlift according to claim 1, wherein a front section of each armrest is adapted such that the modules have a corresponding fit.

9. The stairlift according to claim 4, wherein the seatbelt section of each armrest is adapted such that the winding mechanism and the seatbelt eye have a corresponding fit.

10. A method of configuring a stairlift comprising the steps of:
providing a first armrest;
providing a second armrest;
providing a seat body;
providing a drive unit;
installing a first module at the first armrest and a second module at the second armrest,
wherein:
the first module comprises at least one user control for influencing the movement of the seat body by a hand of a user;
after installation, the first module and the second module are interchangeable between the first armrest and second armrests;
wherein when interchanging the first module and the second module the stairlift is powered; and
the stairlift automatically reconfigures once any change of first and/or second module occurs at the armrests.

11. The method according to claim 10 further comprising the step of:
optionally installing at the first or second armrest a key-lock or an emergency lowering button.

12. The method according to claim 10 further comprising the step of activating at least the first module manually or via a remote control device.

13. A stairlift comprising:
a seat body;
a first armrest positioned on one side of the seat body;
a second armrest positioned on another side of the seat body;
a drive unit operatively coupled to the seat body;
wherein:
each armrest is adapted to comprise at least one module, the at least one module comprises at least one user control for influencing the movement of the seat body by a hand of a user, the at least one module is adapted to be interchangeable between the first and second armrests; and
each armrest optionally comprises at least one user control function including: a key-lock and an emergency lowering button.

14. The stairlift according to claim 13, wherein the first armrest comprises a first compartment for receiving the first module or the second module and the second armrest comprises a second compartment for receiving the second module or the first module, wherein the first compartment and the second compartment each comprises all electrical connectors for transmitting signals provided by the first module and the second module.

15. The stairlift according to claim 13, wherein the first module is adapted to send and receive radio frequency (RF) signals from a remote control device.

16. The stairlift according to claim 13, wherein each armrest comprises a seatbelt section comprising a seatbelt module wherein the seatbelt module comprises:
a winding mechanism;
a seatbelt eye,
wherein the winding mechanism, is located on the first armrest and the seatbelt eye is located on the second armrest or vice versa.

17. The stairlift according to claim 13, wherein the emergency lowering button is located in the first module or in the second module.

18. The stairlift according to claim 13, wherein the key-lock is located in the first module or in the second module.

* * * * *